US011598039B2

(12) United States Patent
Patel et al.

(10) Patent No.: US 11,598,039 B2
(45) Date of Patent: Mar. 7, 2023

(54) WASHING MACHINE APPLIANCE HAVING A REMOVABLE AGITATOR

(71) Applicant: Haier US Appliance Solutions, Inc., Wilmington, DE (US)

(72) Inventors: Neki Jashwant Patel, Hyderabad (IN); Jay Pareshbhai Shinde, Hyderabad (IN); Sanjay Yadav Majjath, Hyderabad (IN); Sanjana Tuniki, Hyderabad (IN); Sasikumar Durairaj, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 37 days.

(21) Appl. No.: 17/188,154

(22) Filed: Mar. 1, 2021

(65) Prior Publication Data

US 2022/0275554 A1 Sep. 1, 2022

(51) Int. Cl.

| | |
|---|---|
| ***D06F 13/02*** | (2006.01) |
| ***D06F 17/10*** | (2006.01) |
| ***D06F 37/20*** | (2006.01) |
| ***D06F 17/06*** | (2006.01) |
| *D06F 13/04* | (2006.01) |
| *D06F 13/06* | (2006.01) |

(52) U.S. Cl.

CPC ..... *D06F 13/02* (2013.01); *D06F 17/06* (2013.01); *D06F 17/10* (2013.01); *D06F 37/20* (2013.01); *D06F 13/04* (2013.01); *D06F 13/06* (2013.01)

(58) Field of Classification Search

CPC ..... D06F 13/02; D06F 13/04; D06F 13/06; D06F 17/06; D06F 17/10

See application file for complete search history.

(56) References Cited

U.S. PATENT DOCUMENTS

| | | | | |
|---|---|---|---|---|
| 1,795,395 | A * | 3/1931 | Hoke | D06F 13/00 68/134 |
| 3,641,791 | A | 2/1972 | Jacobsen | |
| 3,648,486 | A | 3/1972 | Rosinski | |
| 4,193,275 | A | 3/1980 | Bochan | |
| 10,787,761 | B2 | 9/2020 | Czarnecki | |
| 2004/0016267 | A1 * | 1/2004 | Clark | D06F 13/02 68/133 |

(Continued)

FOREIGN PATENT DOCUMENTS

| | | | |
|---|---|---|---|
| CN | 203530690 | U | 4/2014 |
| ES | 279099 | A3 | 11/1962 |
| KR | 100556483 | B1 | 3/2006 |

*Primary Examiner* — Joseph L. Perrin

(74) *Attorney, Agent, or Firm* — Dority & Manning, P.A.

(57) ABSTRACT

A washing machine appliance may include a tub, a basket, an impeller base, and an extended post. The basket may be rotatably positioned within the tub. The impeller base may include a mounting face including a threaded bracket defining a mounting thread extending about a rotation axis. The extended post may be removably attached to the impeller base to rotate therewith. The extended post may include a base body extending along the rotation axis between a bottom end proximal to the impeller base and a top end distal to the impeller base. The extended post may also include auger fin extending radially from the base body between the bottom end and the top end. The mating face may be disposed on the bottom end. The mating face may define a mating thread matched to the mounting thread to rotatably enmesh therewith.

20 Claims, 9 Drawing Sheets

(56) References Cited

U.S. PATENT DOCUMENTS

| | | | | |
|---|---|---|---|---|
| 2018/0155864 | A1* | 6/2018 | Alexander | D06F 39/022 |
| 2019/0062978 | A1* | 2/2019 | Czarnecki | D06F 34/28 |
| 2021/0062382 | A1* | 3/2021 | Andrejczuk | D06F 17/10 |
| 2022/0235512 | A1* | 7/2022 | Bixby | D06F 39/10 |
| 2022/0243379 | A1* | 8/2022 | Adkins | D06F 37/40 |

* cited by examiner

WASHING MACHINE APPLIANCE HAVING A REMOVABLE AGITATOR

FIELD OF THE INVENTION

The present subject matter relates generally to washing machine appliances and an agitation element for the same.

BACKGROUND OF THE INVENTION

A vertical axis washing machine appliance generally includes a tub with a basket rotatably positioned within the tub. Articles to be washed, such as clothes, are placed in the machine's basket. An agitation element can be included in the tub, and can rotate to move articles within the basket to facilitate washing. Agitation elements are typically impellers, single-action agitation elements, or dual-action agitation elements. Generally, such an agitation element reciprocates about a rotation axis (e.g., vertical axis) within the machine's basket. In some instances, fins extend from a rigid shaft of the agitation element to contact and move the articles. The surface of the basket and gravity may be used in conjunction with such agitation elements to impart a circular motion of the articles, known as "turnover," from a top of the basket, to a bottom of the basket, and back up to the top of the basket.

Different agitation elements typically come with different advantages and disadvantages. In the case of single-action and dual-action agitation elements, users may perceive greater agitation and turnover of articles during a washing operation or cycle than with an impeller agitation element. In the case of impeller agitation elements, a greater volume or portion of the wash basket may be available or better able to handle bulky items (e.g., towels, bedding, etc.) than a single-action or dual-action agitation element.

Generally, a consumer or user has to decide which type of agitation element would be most desired at the time of purchase. This obviously limits the user's choice and ability to wash various loads. As a result, it would be useful if a user could have greater flexibility, particularly with regard to the type of agitation element that is used for any given washing operation or wash cycle. Therefore, it would be advantageous to provide a washing machine appliance or assembly wherein an agitation element (or portions thereof) could be readily removed between discrete washing operations or wash cycles (e.g., by a user without the use of any tools).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a tub, a basket, an impeller base, and an extended post. The basket may be rotatably positioned within the tub. The impeller base may be rotatably mounted within the basket and define a rotation axis. The impeller base may include one or more impeller fins extending radially outward from the rotation axis and a mounting face disposed radially inward from the one or more impeller fins. The mounting face may include a threaded bracket defining a mounting thread extending about the rotation axis. The mounting thread may have a variable axial thickness. The extended post may be removably attached to the impeller base to rotate therewith. The extended post may include a base body extending along the rotation axis between a bottom end proximal to the impeller base and a top end distal to the impeller base. The extended post may also include auger fin extending radially from the base body between the bottom end and the top end. The mating face may be disposed on the bottom end. The mating face may define a mating thread matched to the mounting thread to rotatably enmesh therewith.

In another exemplary aspect of the present disclosure, a washing machine appliance is provided. The washing machine appliance may include a tub, a basket, an impeller base, and an extended post. The basket may be rotatably positioned within the tub. The impeller base may be rotatably mounted within the basket and define a rotation axis. The impeller base may include one or more impeller fins extending radially outward from the rotation axis, a mounting face disposed radially inward from the one or more impeller fins, and an impeller cap. The mounting face may include a threaded bracket defining a central passage and a mounting thread extending about the rotation axis. The impeller cap may extend across the central passage to move axially therealong. The extended post may be removably attached to the impeller base to rotate therewith. The extended post may include post may include a base body extending along the rotation axis between a bottom end proximal to the impeller base and a top end distal to the impeller base. The extended post may also include an auger fin extending radially from the base body between the bottom end and the top end. The extended post may further include a mating face disposed on the bottom end. The mating face may define a mating thread matched to the mounting thread to rotatably enmesh therewith.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
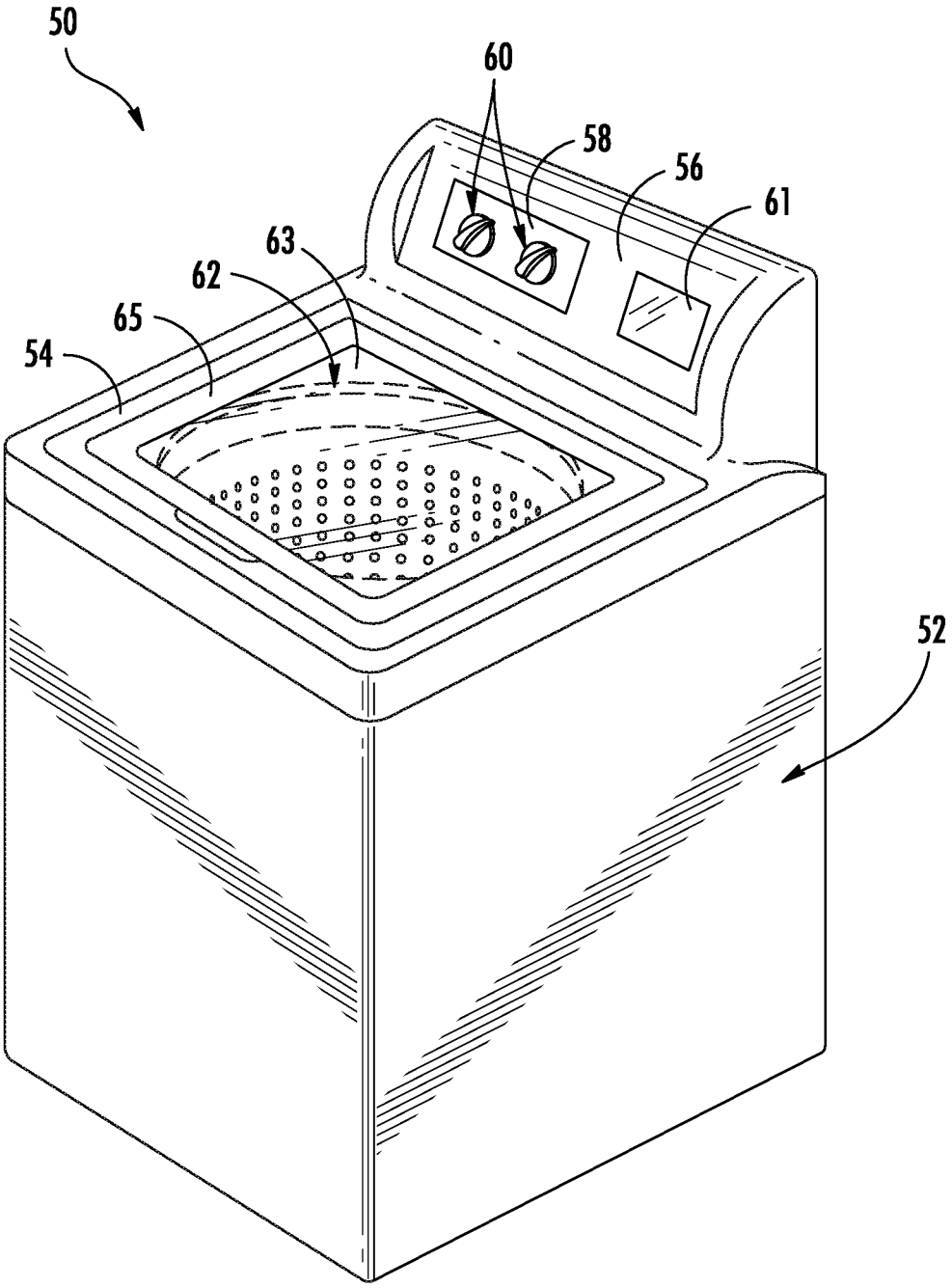
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The phrase "in one embodiment," does not necessarily refer to the same embodiment, although it may. The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
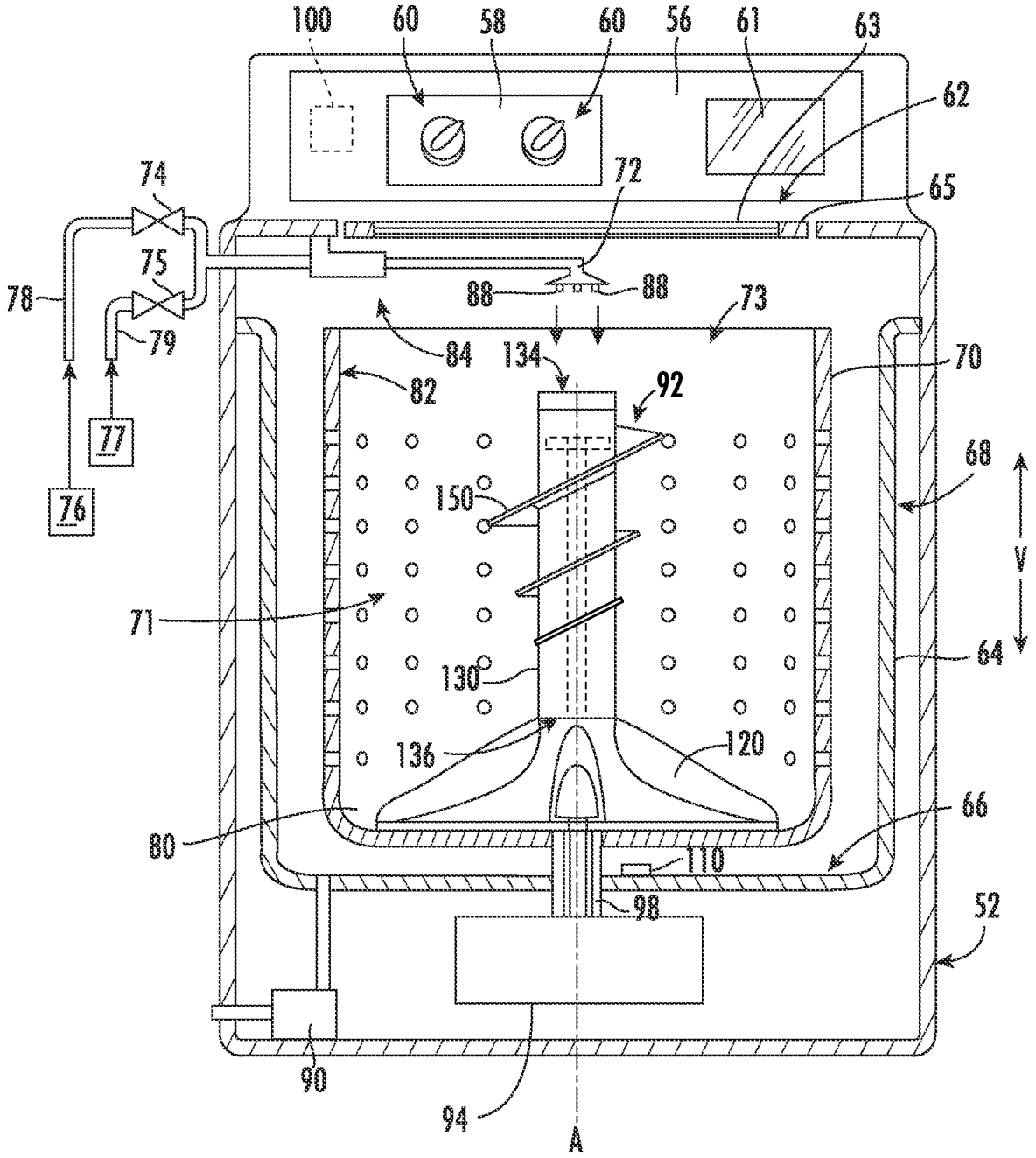
FIG. 2 provides a sectional elevation view of the exemplary washing machine appliance of FIG. 1.
Figure 3:
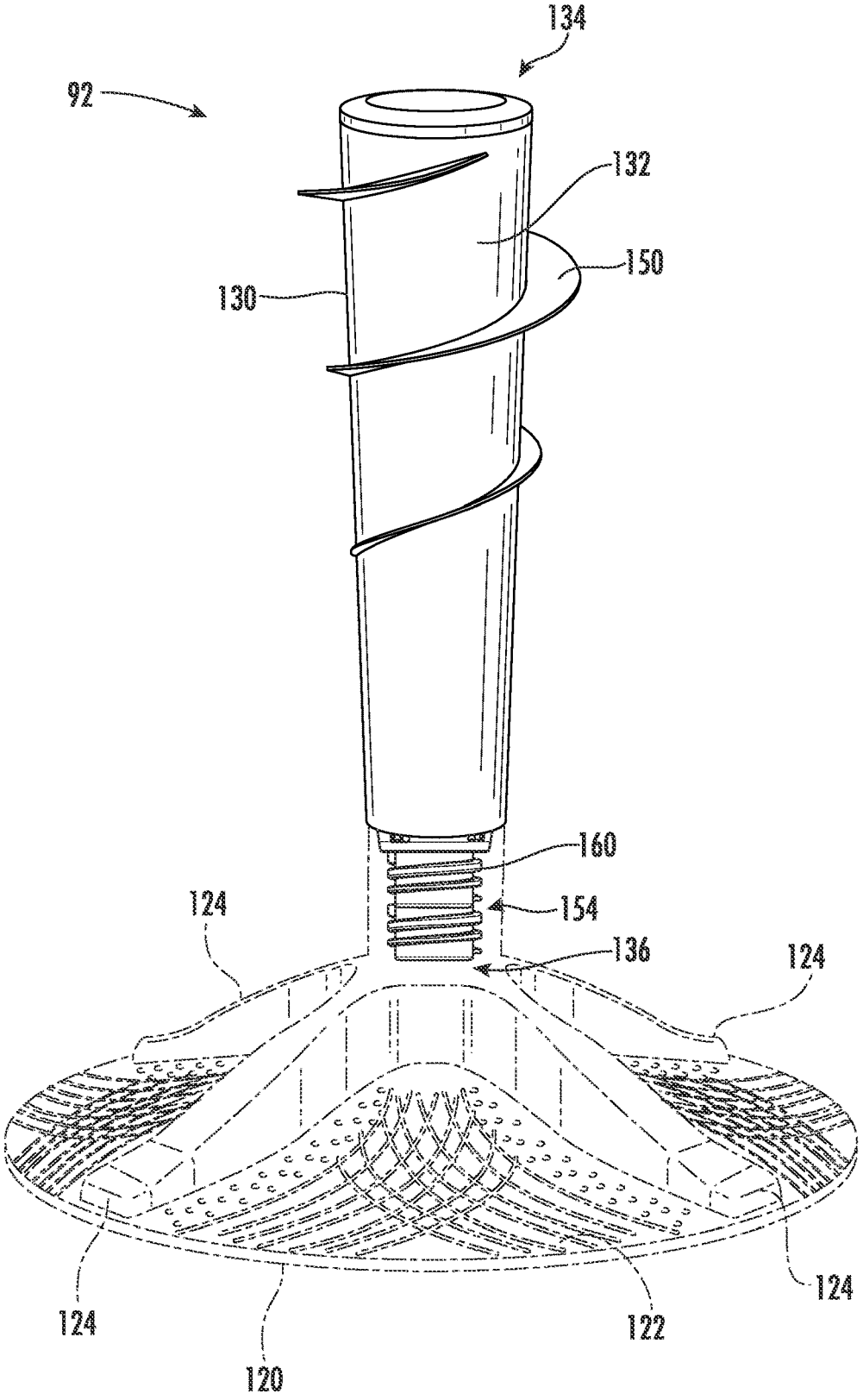
FIG. 3 provides a perspective view of an agitation element, in isolation, according to exemplary embodiments of the present disclosure.
Figure 4:
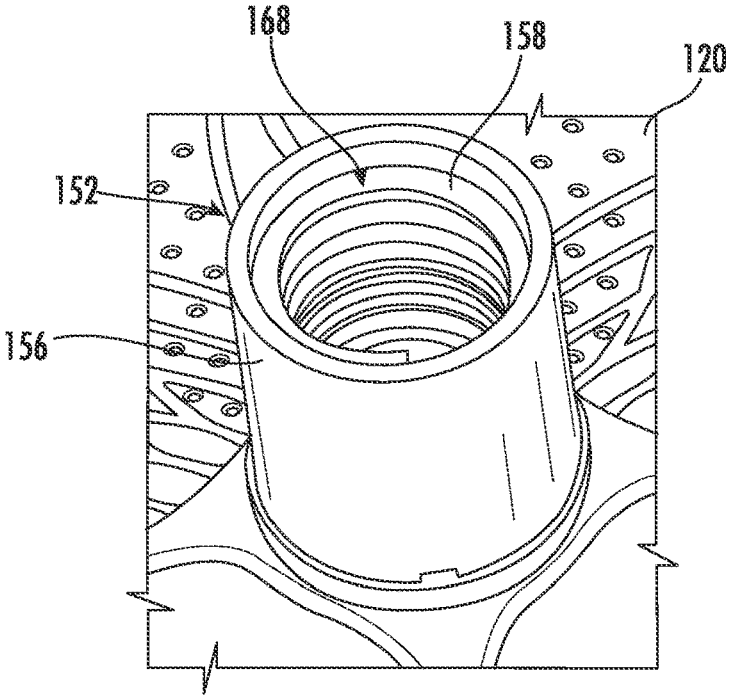
FIG. 4 provides a perspective view of a portion of the impeller base of the exemplary agitation element of FIG. 3.
Figure 5:
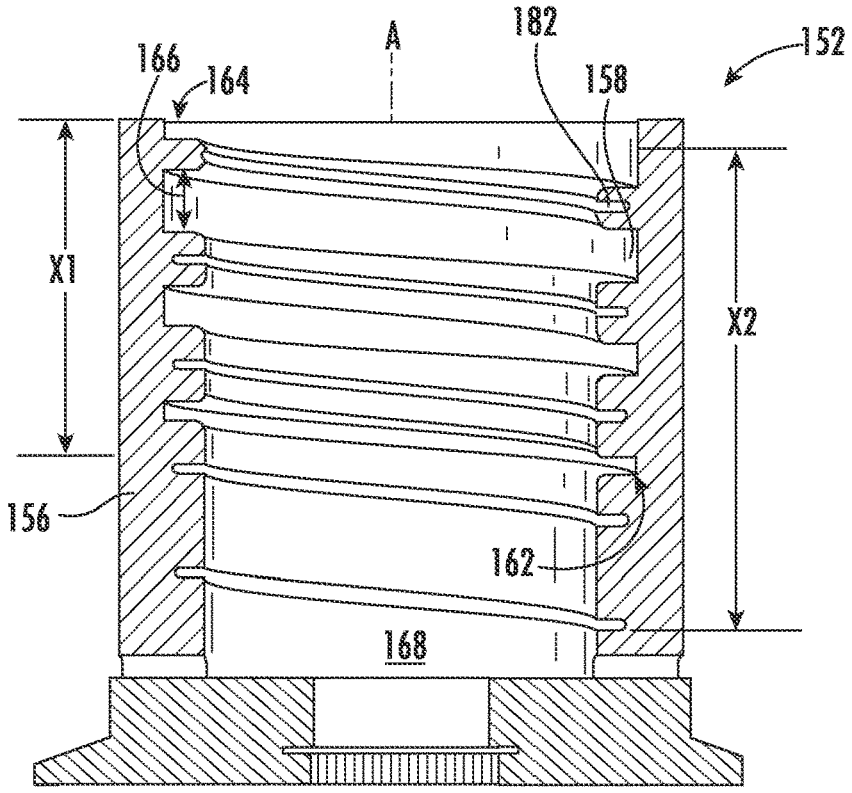
FIG. 5 provides a sectional elevation view of a portion of the impeller base of the exemplary agitation element of FIG. 3.
Figure 6:
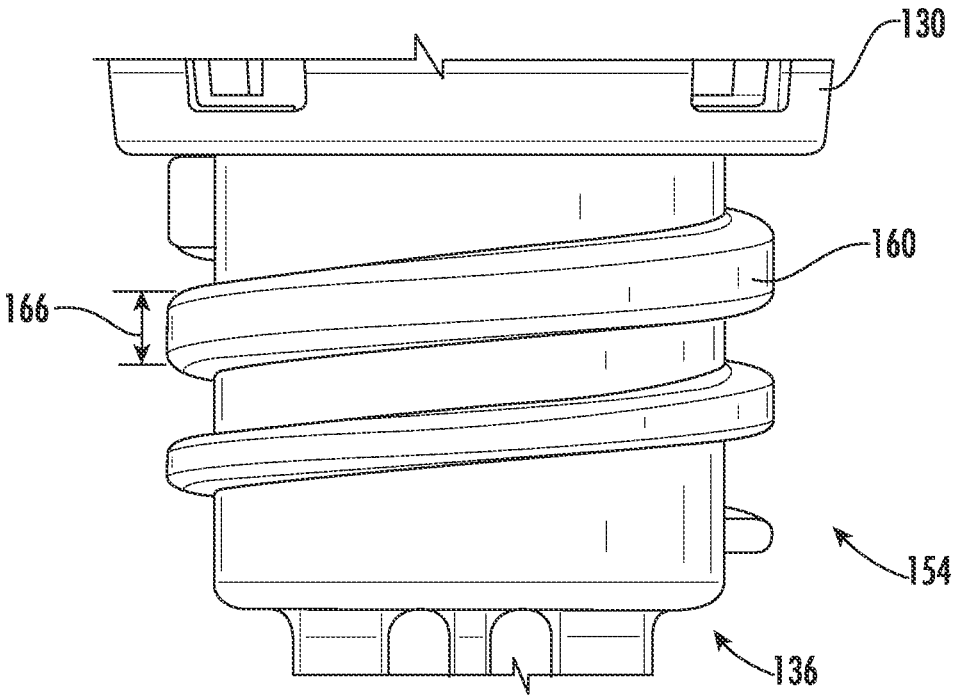
FIG. 6 provides an elevation view of a portion of the extended post of the exemplary agitation element of FIG. 3.
Figure 7:
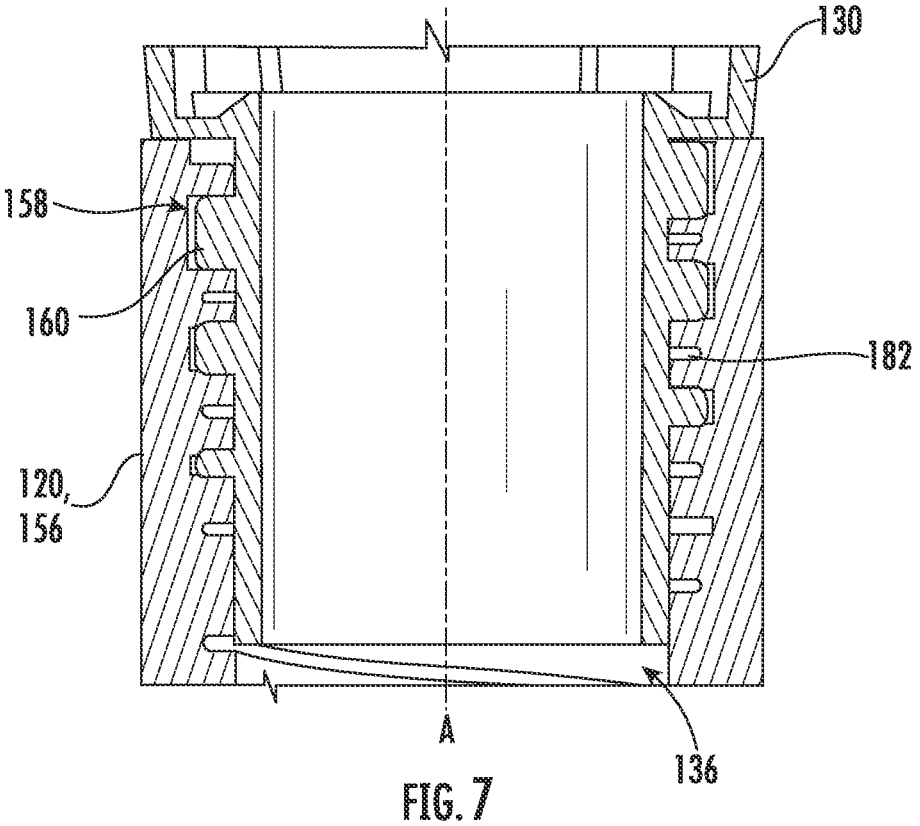
FIG. 7 provides a sectional elevation view of a portion of the extended post received within the impeller base of the exemplary agitation element of FIG. 3.
Figure 8:
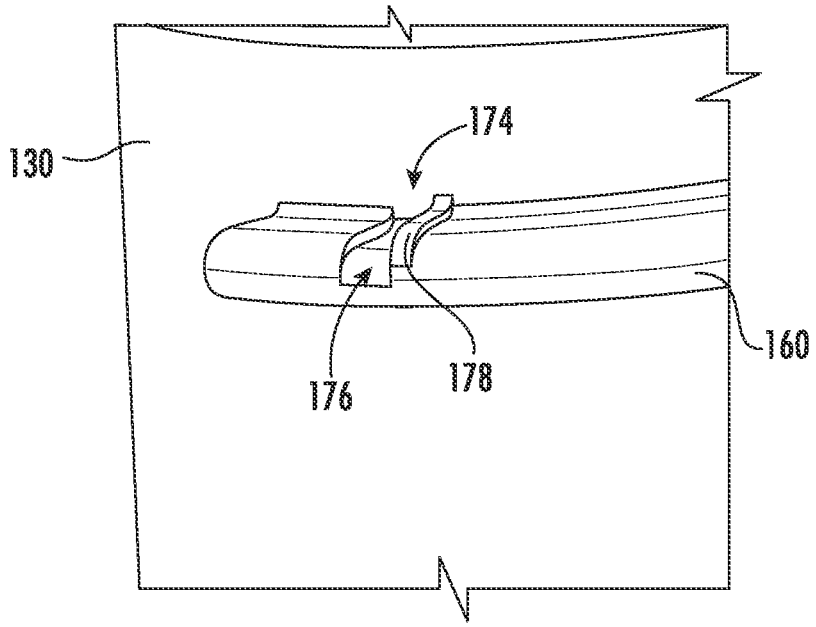
FIG. 8 provides a perspective view of a portion of a mating thread 160 of the extended post 130 of the exemplary agitation element of FIG. 3.
Figure 9:
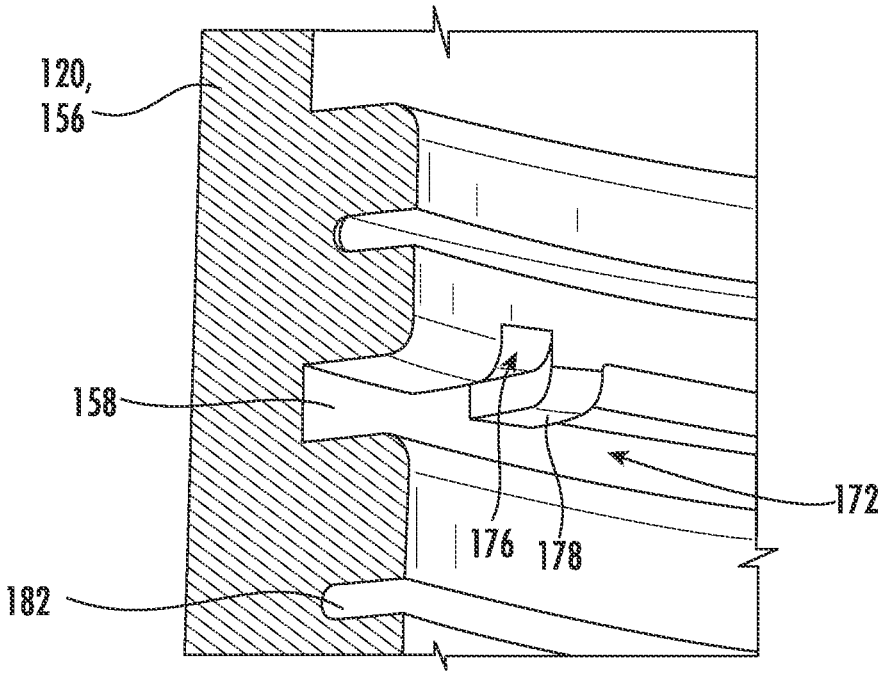
FIG. 9 provides a perspective view of a portion of a mounting thread 158 of the impeller base 120 of the exemplary agitation element of FIG. 3.

Turning now to the figures, FIGS. 1 and 2 provide separate views of a washing machine appliance 50 according to exemplary embodiments of the present disclosure. As shown, washing machine appliance 50 generally defines a vertical direction V, a lateral direction L, and a transverse direction T. The vertical direction V, lateral direction L, and transverse direction T are each mutually perpendicular and form an orthogonal direction system.

Washing machine appliance 50 may include a cabinet 52 and a cover 54. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one embodiment, a display 61 indicates selected features, a countdown timer, or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen (e.g., on display 61).

A lid 62 may be mounted to cover 54 and rotatable between an open position (not shown) facilitating access to a tub, also referred to as a wash tub, 64 located within cabinet 52 and a closed position (FIG. 1) forming an enclosure over tub 64. Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 itself can generally form the lid 62. In other embodiments, the lid 62 includes the panel 63 and a frame 65 surrounding and encasing the panel 63. Alternatively, panel 63 need not be transparent.

As may be seen in FIG. 2, tub 64 includes a bottom wall 66 and a sidewall 68. A wash drum or basket 70 is rotatably mounted within tub 64. In particular, basket 70 is rotatable about a central axis, which may when properly balanced and positioned in the embodiment illustrated be a vertical axis. Thus, washing machine appliance is generally referred to as a vertical axis washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g. water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (i.e. sprayed or poured) into the tub 64.

Various valves may regulate the flow of fluid through nozzle 72. For example, a flow regulator may be provided to control a flow of hot or cold water into the wash chamber of washing machine appliance 50. For the embodiment depicted, the flow regulator includes a hot water valve 74 and a cold water valve 75. The hot and cold water valves 74, 75 are used to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity assisted flow to drain tub 64.

As will be described in greater detail herein, an agitation element 92 is oriented to rotate about the rotation axis A (e.g., parallel to the vertical direction V). Generally, agitation element 92 includes an impeller base 120 and extended post 130. The agitation element 92 depicted is positioned within the basket 70 to impart motion to the articles and liquid in the chamber 73 of the basket 70. More particularly, the agitation element 92 depicted is provided to impart downward motion of the articles along the rotation axis A. For example, with such a configuration, during operation of the agitation element 92 the articles may be moved downwardly along the rotation axis A at a center of the basket 70, outwardly from the center of basket 70 at the bottom portion 80 of the basket 70, then upwardly along the rotation axis A towards the top portion 82 of the basket 70.

In optional embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be used. The pressure sensor 110 may generally measure the pressure of water in the tub 64. This pressure can then be used to estimate the height or amount of water in the tub 64. Additionally, a suitable speed sensor can be connected to the motor 94, such as to the output shaft 98 thereof, to measure speed and indicate operation of the motor 94. Other suitable sensors, such as temperature sensors, water sensors, moisture sensors, etc., may additionally be provided in the washing machine appliance 50.

Operation of washing machine appliance 50 is controlled by a processing device or controller 100, that is operatively coupled to the input selectors 60 located on washing machine backsplash 56 for user manipulation to select washing machine cycles and features. Controller 100 may further be operatively coupled to various other components of appliance 50, such as the flow regulator (including valves 74, 75), motor 94, pressure sensor 110, other suitable sensors, etc. In response to user manipulation of the input selectors 60, controller 100 may operate the various components of washing machine appliance 50 to execute selected machine cycles and features.

While described in the context of specific embodiments of washing machine appliance 50, using the teachings disclosed herein it will be understood that washing machine appliance 50 is provided by way of example only. Other washing machine appliances having different configurations, different appearances, or different features may also be used with the present subject matter as well.

Turning now generally to FIGS. 2 through 11, agitation element 92 may include or be provided as a removable agitation element having an extended post 130 selectively attached to (and removable from) impeller base 120. Generally, impeller base 120 includes an impeller platform 122 having one or more impeller fins 124 extending therefrom, as would generally be understood. In the illustrated embodiments, impeller base 120 includes four discrete impeller fins 124 that extends upward from impeller platform 122 and radially outward from rotation axis A. Nonetheless, it is understood that any suitable number of impeller fins 124 may be provided. When assembled, impeller base 120 is generally connected to or in mechanical communication with motor 94, such as through the output shaft 98. Thus, impeller base 120 may be rotated, oscillated, or otherwise motivated by motor 94 (e.g., during a washing operation or wash cycle, as directed by controller 100).

When assembled, extended post 130 may generally extend along the rotation axis A above the impeller base 120. Specifically, extended post 130 may include a base body 132 extending along the rotation axis A between a bottom end 136 and a top end 134. As shown, base body 132 may be mounted within wash chamber 73 such that bottom end 136 is attached or otherwise proximal to the impeller base 120 while top end 134 is held distal to impeller base 120. Between top end 134 and bottom end 136, one or more auger fins 150 may extend radially from extended post 130 (e.g., to engage and agitate articles within wash chamber 73). In the illustrated embodiments, auger fin 150 is formed as a helical coil wrapped about extended post 130. Nonetheless, any suitable shape or number of auger fins may be provided in alternative embodiments, as would be understood.

Turning especially to FIGS. 3 through 7 impeller base 120 may provide a mounting face 152 that selectively connects to a mating face 154 of extended post 130. As shown, mounting face 152 is disposed inward from the impeller fins 124. Thus, mounting face 152 may be located closer to rotation axis A than impeller fins 124. In some such embodiments, mounting face 152 is generally coaxial with rotation axis A (e.g., at a radial center of impeller base 120). At or within mounting face 152, impeller base 120 may include a threaded bracket 156 that defines a mounting thread 158. As shown, mounting thread 158 extends about the rotation axis A or a central passage 168 defined by threaded bracket 156 (e.g., parallel to the rotation axis A). Thus, mounting thread 158 may follow a helical path that surrounds rotation axis A and provides multiple turns along an axial distance X1, which itself is defined along the rotation axis A from a lower thread tip 162 to an upper thread tip 164.

Generally, the mounting thread 158 varies along the axial distance X1. In certain embodiments, the axial thickness 166 of mounting thread 158 varies. For instance, the axial thickness 166 may increase in an upward direction along the rotation axis A away from the impeller base 120. Thus, along the axial distance X1 from the lower thread tip 162 to the upper thread tip 164, the axial thickness 166 of mounting thread 158 may generally increase relative to proximity to upper thread tip 164. Contrarily, the axial thickness 166 of mounting thread 158 may generally decrease along the axial distance X1 relative to proximity to lower thread tip 162. In turn, the axial thickness 166 of mounting thread 158 at the upper thread tip 164 may be larger than the axial thickness 166 of mounting thread 158 at the lower thread tip 162. Optionally, the major thread diameter of mounting thread 158 (e.g., maximum radius of central passage 168 along the axial distance X1) may remain constant along the axial distance X1. The minor thread diameter may be constant or, alternatively, varied along the axial distance X1. Additionally or alternatively, the pitch of mounting thread 158 (i.e., spacing between adjacent crests) may be constant along the axial distance X1.

Extended post 130 may provide a complementary structure to engage or interlock with the mounting face 152 of impeller base 120. In some embodiments, extended post 130 includes a mating face 154 disposed on bottom end 136 to rest against or interlock with the mounting face 152. Specifically, mating face 154 may define a mating thread 160 matched to the mounting thread 158 to rotatably enmesh therewith. In other words, mating thread 160 is defined as the complementary thread to mounting thread 158 and can screw thereon such that extended post 130 and impeller base 120 can rotate in tandem with axial movement along rotation axis A (e.g., within central passage 168). Thus, mating thread 160 includes the same threading (e.g., axial thread thickness, pitch, major diameter, minor diameter, lead, etc.) as mounting thread 158. Advantageously, the engagement or enmeshing of mating thread 160 and mounting thread 158 may form a selective, self-locking, friction-fit connection between impeller base 120 and extended post 130.

Figure 13:
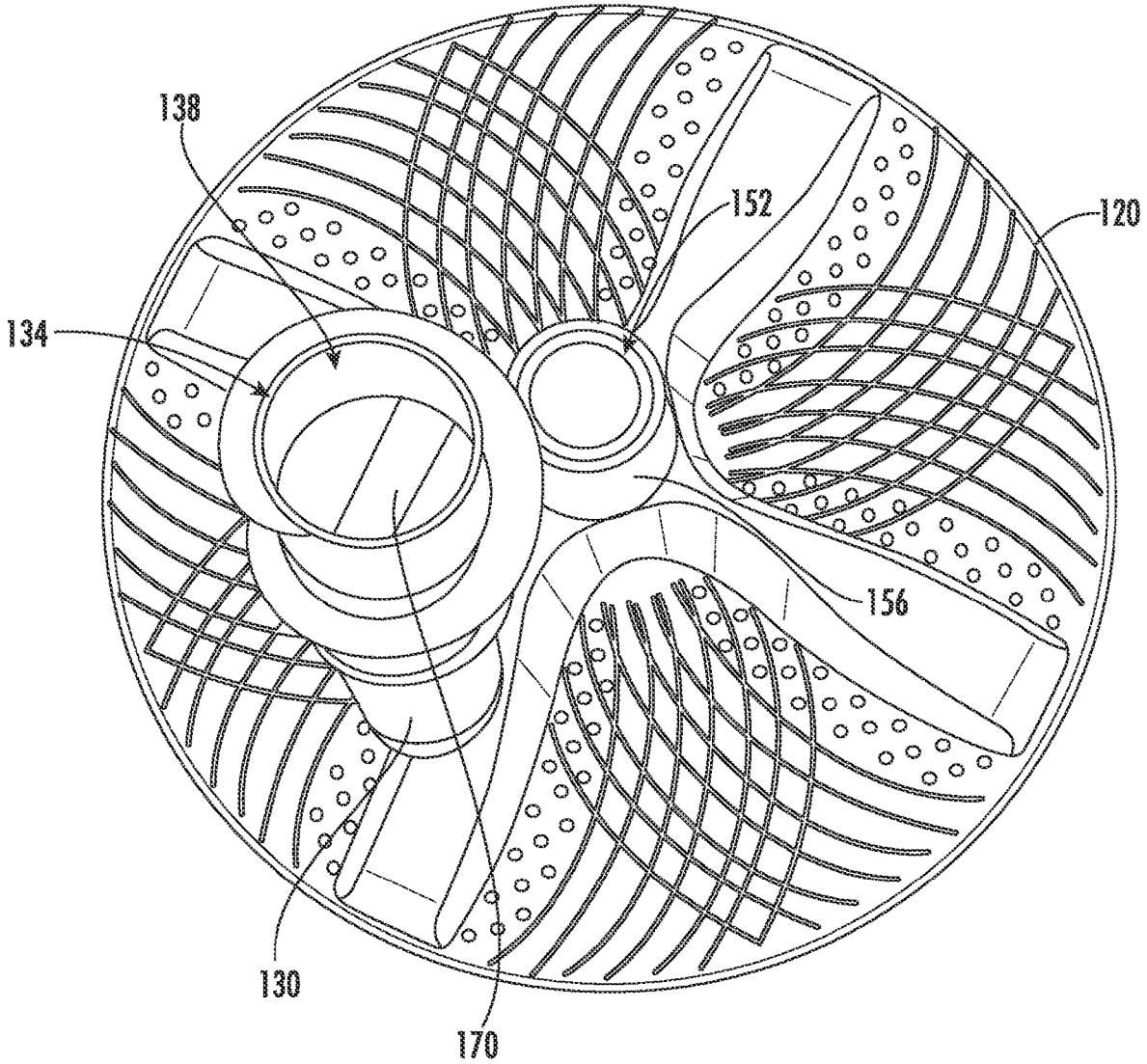
FIG. 13 provides a top perspective view of the separated extended post and impeller base of the exemplary agitation element of FIG. 3.

Turning briefly to FIG. 13, as noted above, extended post 130, including base body 132 may be mounted within wash chamber 73 such that bottom end 136 is attached or otherwise proximal to the impeller base 120 (e.g., via mounting thread 158 and mating thread 160 engagement) while top end 134 is held distal to impeller base 120. In some embodiments, base body 132 includes or is attached to an enlarged handle 170. Specifically, enlarged handle 170 may be disposed at or proximal to top end 134. Thus, extended post 130 may define enlarged handle 170 at top end 134. As shown, enlarged handle 170 may extend radially across an interior cavity 138 of base body 132. In turn, a user may be able to notably hold and rotate extended post 130 relative to impeller base 120 (e.g., as extended post 130 is being attached to or removed from impeller base 120).

Turning especially to FIGS. 6 through 9, one or more detents (e.g., axial detents 172, 174) may be provided between mounting thread 158 and mating thread 160. Generally, the axial detents 172, 174 may provide a notch or ridge within a thread that can restrain or restrict roto-translation of mating thread 160 relative to mounting thread 158 (or vice versa). Specifically, the axial detents 172, 174 may engage each other to provide an increased friction fit between mounting thread 158 and mating thread 160 or otherwise provide an indication (e.g., tactile or auditory feedback) that extended post 130 is secured to impeller base 120. For instance, when extended post 130 is attached to impeller base 120, one axial detent may be matched to the other to be received therein. In particular, a first axial detent 172 defined by mounting thread 158 may be engaged with a second axial detent 174 defined by mating thread 160, and the second axial detent 174 may be matched to the first axial detent 172 for receipt therein. Optionally, each detent may include a discrete notch 176 and ridge 178, wherein the ridge 178 is formed as an elastic structure to deform before being received within or removed from a matched notch 176.

Figure 10:
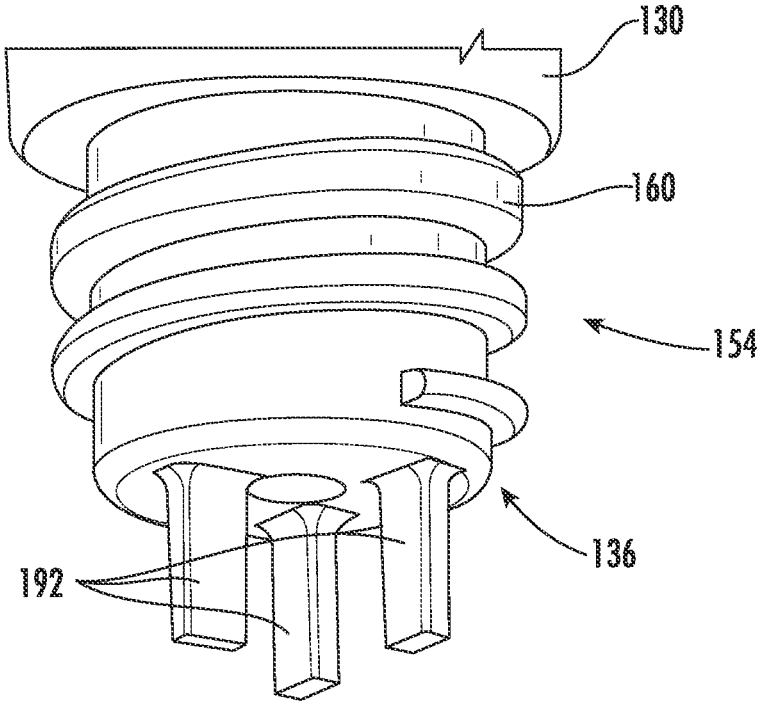
FIG. 10 provides a perspective view of a bottom portion of the extended post of the exemplary agitation element of FIG. 3.
Figure 11:
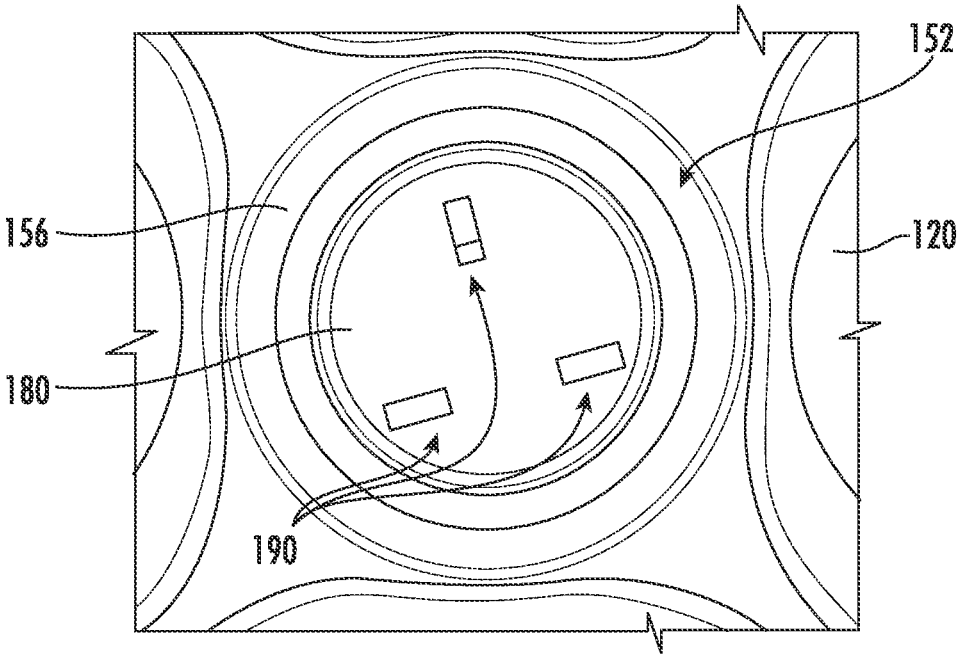
FIG. 11 provides a perspective view of a top portion of the impeller base of the exemplary agitation element of FIG. 3.
Figure 12:
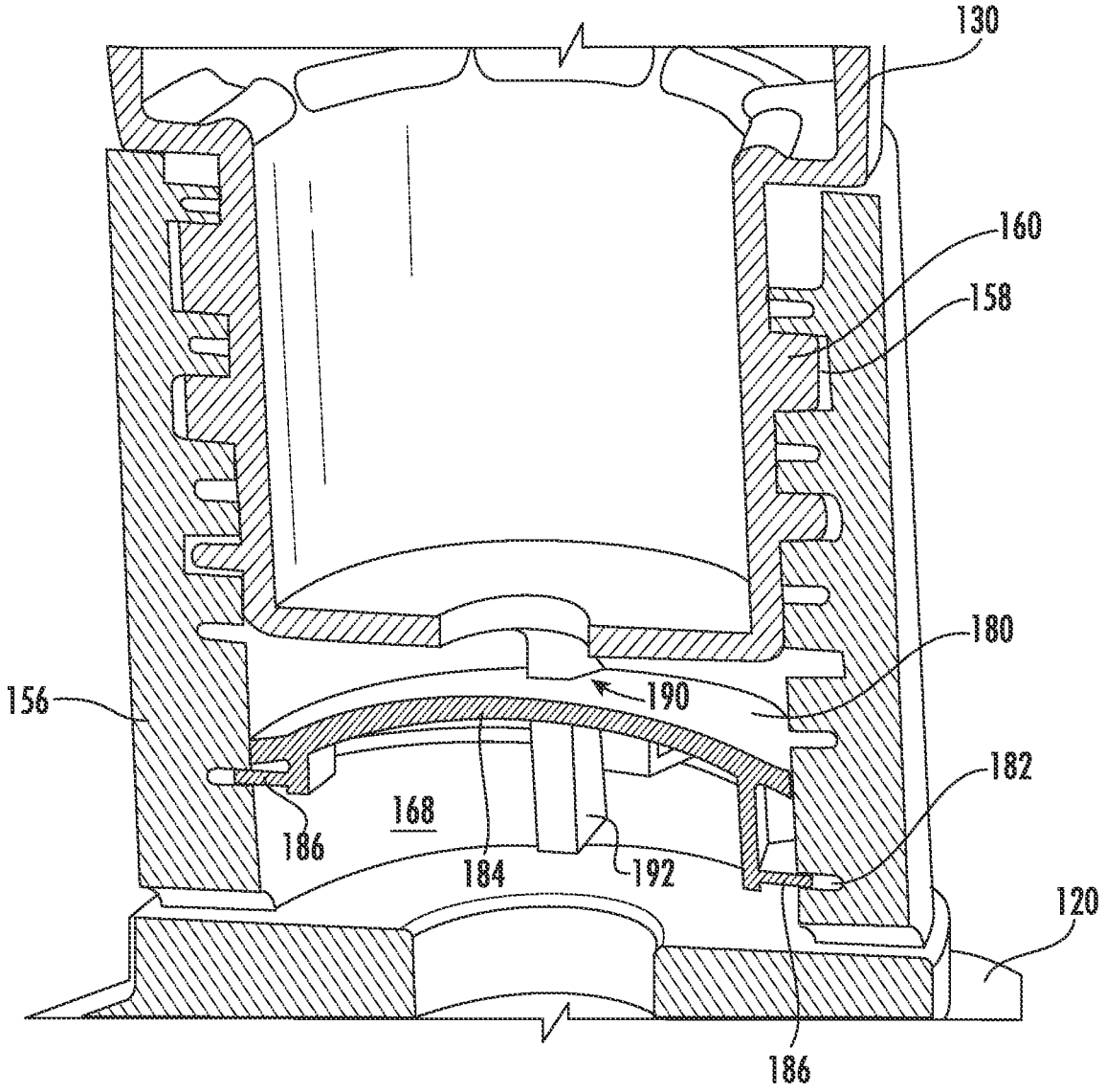
FIG. 12 provides a sectional perspective view of a portion of the extended post received within the impeller base of the exemplary agitation element of FIG. 3.

Turning especially to FIGS. 10 through 12, certain embodiments further include an impeller cap 180 that can be mounted on or included within impeller base 120 to cover central passage 168. By covering, central passage 168, impeller cap 180 may generally hide central passage 168 from a user's view or block it from contacting/receiving articles within wash chamber 73 when extended post 130 is removed from wash chamber 73. In some embodiments, impeller cap 180 is movably mounted on mounting face 152. Specifically, impeller cap 180 may be mounted to move axially along central passage 168 (e.g., along or parallel to rotation axis A). For instance, impeller cap 180 may be mounted for roto-translation within central passage 168. In some such embodiments, mounting face 152 further defines a secondary cap thread 182 about the rotation axis A. Impeller cap 180 may include a cap cover 184 spanning central passage 168 and one or more radial flanges 186 that extend radially outward from cap cover 184 to be held within secondary cap thread 182 and move therealong.

As shown, secondary cap thread 182 may be defined independent of mounting thread 158. While both may extend about rotation axis A, secondary cap thread 182 and mounting thread 158 may be kept apart from each other such that the threads 158, 182 do not intersect each other. Nonetheless, in some embodiments, both secondary cap thread 182 and mounting thread 158 may span an overlapping or common axial distance. Additionally or alternatively, the axial distance X2 spanned by the secondary cap thread 182 may extend below at least a portion of the axial distance X1 spanned by mounting thread 158. Further additionally or alternatively, the axial distance X1 spanned by the mounting thread 158 may extend above at least a portion of the axial distance X2 spanned by secondary cap thread 182. Optionally, the secondary cap thread 182 may have a constant axial thickness, pitch, major diameter, minor diameter, or lead along the axial distance X2.

In certain embodiments, impeller cap 180 and extended post 130 form complementary structures to guide placement of extended post 130 relative to impeller base 120 and rotation of impeller cap 180 within central passage 168. For instance, impeller cap 180 may define multiple guide apertures 190 that extend (e.g., axially or vertically) through cap cover 184. Extended post 130 may further include multiple guide tabs 192 that extend axially from bottom end 136 to be received within the guide apertures 190. As shown, the shape of the guide tabs 192 may complement or form the positive of guide apertures 190. Optionally, the guide apertures 190 and guide tabs 192 may be formed in a distinct or non-identical pattern such that the shape or orientation of each guide aperture 190 and guide tab 192 may be different from at least one other guide aperture 190 and guide tab 192, respectively. Thus, a user may notably be confident that extended post 130 is properly positioned relative to impeller base 120 prior to screwing or otherwise attaching extended post 130 to impeller base 120.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:
a tub;
a basket rotatably positioned within the tub;
an impeller base rotatably mounted within the basket and defining a rotation axis, the impeller base comprising
one or more impeller fins extending radially outward from the rotation axis, and
a mounting face disposed radially inward from the one or more impeller fins, the mounting face comprising a threaded bracket defining a mounting thread extending about the rotation axis, the mounting thread having a variable axial thickness; and
an extended post removably attached to the impeller base to rotate therewith, the extended post comprising
a base body extending along the rotation axis between a bottom end proximal to the impeller base and a top end distal to the impeller base,
an auger fin extending radially from the base body between the bottom end and the top end, and
a mating face disposed on the bottom end, the mating face defining a mating thread matched to the mounting thread to rotatably enmesh therewith.

2. The washing machine appliance of claim 1, wherein the variable axial thickness increases in an upward direction away from the impeller base.

3. The washing machine appliance of claim 1, wherein the extended post further defines an enlarged handle at the top end.

4. The washing machine appliance of claim 1, wherein the mounting thread defines a first axial detent, and wherein the mating thread defines a second axial detent matched to the first axial detent for receipt therein.

5. The washing machine appliance of claim 1, wherein the mounting face further defines a secondary cap thread about the rotation axis, the secondary cap thread being independent of the mounting thread.

6. The washing machine appliance of claim 5, wherein the secondary cap thread spans a common axial distance with the mounting thread.

7. The washing machine appliance of claim 5, wherein the secondary cap thread has a constant axial thickness.

8. The washing machine appliance of claim 5, wherein the mounting face defines a central passage about which the mounting thread and the secondary cap thread extend, wherein the washing machine appliance further comprises an impeller cap extending across the central passage and engaged with the secondary cap thread to move therealong.

9. The washing machine appliance of claim 8, wherein the impeller cap defines a plurality of guide apertures, and wherein the extended post comprises a plurality of guide tabs extending axially from the bottom end and received within the plurality of guide apertures.

10. A washing machine appliance comprising:
a tub;
a basket rotatably positioned within the tub;
an impeller base rotatably mounted within the basket and defining a rotation axis, the impeller base comprising
one or more impeller fins extending radially outward from the rotation axis,
a mounting face disposed radially inward from the one or more impeller fins, mounting face comprising a threaded bracket defining a central passage and a mounting thread extending about the rotation axis, and
an impeller cap extending across the central passage to move axially therealong;
an extended post removably attached to the impeller base to rotate therewith, the extended post comprising
a base body extending along the rotation axis between a bottom end proximal to the impeller base and a top end distal to the impeller base,
an auger fin extending radially from the base body between the bottom end and the top end, and
a mating face disposed on the bottom end, the mating face defining a mating thread matched to the mounting thread to rotatably enmesh therewith,
wherein the mounting thread has a variable axial thickness increasing in an upward direction away from the impeller base.

11. The washing machine appliance of claim 10, wherein the extended post further defines an enlarged handle at the top end.

12. The washing machine appliance of claim 10, wherein the mounting thread defines a first axial detent, and wherein the mating thread defines a second axial detent matched to the first axial detent for receipt therein.

13. The washing machine appliance of claim 10, wherein the mounting face further defines a secondary cap thread about the rotation axis, the secondary cap thread being independent of the mounting thread.

14. The washing machine appliance of claim 13, wherein the secondary cap thread spans a common axial distance with the mounting thread.

15. The washing machine appliance of claim 13, wherein the secondary cap thread has a constant axial thickness.

16. The washing machine appliance of claim 13, wherein the impeller cap is engaged with the secondary cap thread to move therealong.

17. The washing machine appliance of claim 16, wherein the impeller cap defines a plurality of guide apertures, and wherein the extended post comprises a plurality of guide tabs extending axially from the bottom end and received within the plurality of guide apertures.

18. A washing machine appliance comprising:
a tub;
a basket rotatably positioned within the tub;
an impeller base rotatably mounted within the basket and defining a rotation axis, the impeller base comprising a threaded bracket defining a mounting thread extending about the rotation axis, the mounting thread having a variable axial thickness; and
an extended post removably attached to the impeller base to rotate therewith, the extended post comprising
a base body extending along the rotation axis between a bottom end proximal to the impeller base and a top end distal to the impeller base, and a mating face disposed on the bottom end, the mating face defining a mating thread matched to the mounting thread to rotatably enmesh therewith.

19. The washing machine appliance of claim 18, wherein the variable axial thickness increases in an upward direction away from the impeller base.

20. The washing machine appliance of claim 18, wherein the mounting thread defines a first axial detent, and wherein the mating thread defines a second axial detent matched to the first axial detent for receipt therein.

* * * * *